United States Patent [19]

Meshi et al.

[11] 4,247,925

[45] Jan. 27, 1981

[54] GAME MICROCOMPUTER

[76] Inventors: Joseph Meshi, 2268 Golden Cir., Newport Beach, Calif. 92660; Jeffrey R. Ponsor, 11230 Calle Dario, San Diego, Calif. 92126

[21] Appl. No.: 924,181

[22] Filed: Jul. 13, 1978

[51] Int. Cl.[3] ..... G04F 8/00

[52] U.S. Cl. ..... 368/3; 368/10; 364/900

[58] Field of Search ..... 58/23 R, 23 BA, 145 D, 58/39.5; 364/705, 900; 368/3, 10

[56] References Cited

U.S. PATENT DOCUMENTS

| | | | |
|---|---|---|---|
| 4,028,880 | 6/1977 | Ueda | 58/23 BA |
| 4,062,180 | 12/1977 | Meshi et al. | 58/145 D |
| 4,079,583 | 3/1978 | Larsen | 58/145 D X |

*Primary Examiner*—Ulysses Weldon
*Attorney, Agent, or Firm*—Raymond L. Madsen

[57] ABSTRACT

A dedicated microcomputer for games, sports and other recreational activities has a central processing unit, a keyboard input, random access and pre-programmed read only memories and a digital display, the read only memory being programmed with a chess tournament mode in which remaining time for each player and remaining moves for each player may be displayed, a chess blitz mode in which remaining grace time is displayed for each move by each player, a rapid transit mode in which remaining game time is displayed for each player, an events-up mode where a time count up from a pre-selected number is displayed and an events-down mode where a time count down from a pre-selected number is displayed. All leading zeros of the display are blanked to conserve power. A warning alarm may be activated at any point in any count. The two least significant digits may be blanked when not required to further conserve power. Keyboard data may be stored in the memory to provide time periods in which a given number of moves must be made and to provide a number of moves or events required within a time period. Illegal moves may be corrected and move counts may be adjusted. Data may be stored for game replay under the same data conditions. A low battery alarm is provided. The decimal point is blanked in the non-active player count display. The time of each move or event for each player may be stored for review.

9 Claims, 5 Drawing Figures

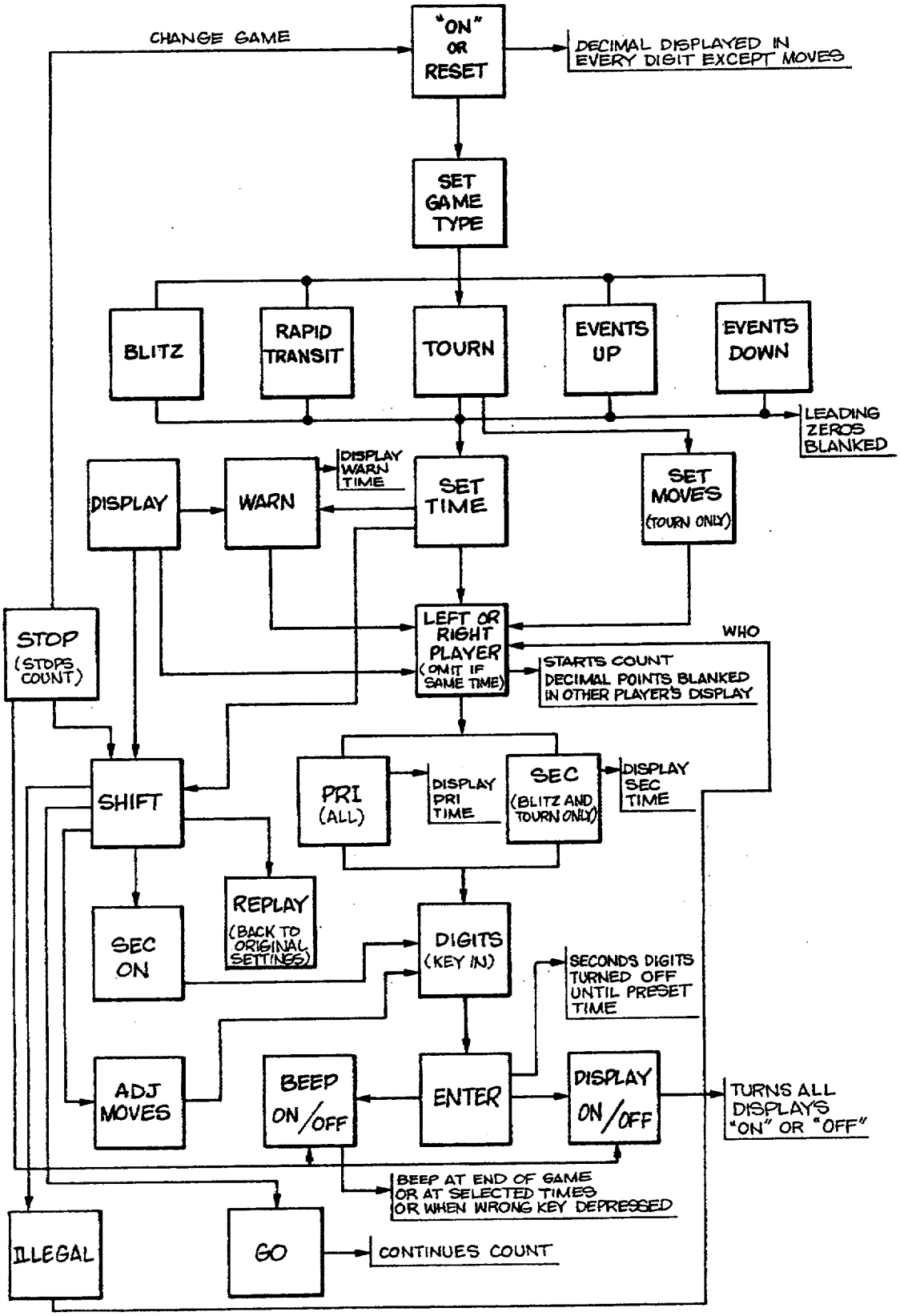
CHANGE GAME
"ON" OR RESET
DECIMAL DISPLAYED IN EVERY DIGIT EXCEPT MOVES
SET GAME TYPE
BLITZ
RAPID TRANSIT
TOURN
EVENTS UP
EVENTS DOWN
LEADING ZEROS BLANKED
DISPLAY
WARN
DISPLAY WARN TIME
SET TIME
SET MOVES (TOURN ONLY)
STOP (STOPS COUNT)
LEFT OR RIGHT PLAYER (OMIT IF SAME TIME)
WHO
STARTS COUNT
DECIMAL POINTS BLANKED IN OTHER PLAYER'S DISPLAY
SHIFT
PRI (ALL)
DISPLAY PRI TIME
SEC (BLITZ AND TOURN ONLY)
DISPLAY SEC TIME
REPLAY (BACK TO ORIGINAL SETTINGS)
SEC ON
DIGITS (KEY IN)
SECONDS DIGITS TURNED OFF UNTIL PRESET TIME
ADJ MOVES
BEEP ON/OFF
ENTER
DISPLAY ON/OFF
TURNS ALL DISPLAYS "ON" OR "OFF"
BEEP AT END OF GAME OR AT SELECTED TIMES OR WHEN WRONG KEY DEPRESSED
ILLEGAL
GO
CONTINUES COUNT

GAME MICROCOMPUTER

The present invention relates to electronic microcomputers and more particularly to electronic game time and events processors and displays.

With the advent of the general purpose computer it has been the challenge of the computer programmer to play games with the computer by designing a program of instructions to be written into the computer memory according to which the computer will perform various operational and logic tasks in response to certain input instructions and data. The general purpose computer provides a very expensive toy for this purpose. Although computational operations of a lesser sophistication than that of a general purpose computer are required for many games played with time and events as important parameters, there has been heretofore no practical design and development of such a dedicated limited purpose game computer. There has been no game computer which offers a program of functions and operations designed to display time and events, to indicate the occurrence of certain designated happenings and to modify the display according to a limited program of instructions. There is a need for a low cost, small sized, dedicated microcomputer for the storage, processing, and display of data in the field of games, sports and other recreational activities.

In the field of game time and events processors and displays, it has been the general practice to employ a multiplicity of "hardwired" logic elements connected together in a predetermined logic pattern to obtain a desired output result and display in response to given input data set into the logic circuit by series of switches. Such a logic device is illustrated in U.S. Pat. No. 4,062,180, issued Dec. 13, 1977 to this inventor for an electronic chess clock. Although such a circuit connection of logic elements has served the purpose, it has not proved entirely satisfactory under all conditions of service for the reason that it is not possible to provide a multiplicity of additional output results and displays or a flexibility of output results and displays other than that designed into and provided by the specific circuit arrangement and electrical connection of logic elements.

Those concerned with the development of game time and events processors and displays have long recognized the need for a versatile device having a diverse program of activities and functions which can be selected and activated by simple input control elements. The present invention fulfills this need.

One of the most critical problems confronting designers of game time and events processors and displays has been the design of a processor and display that can be battery operated and yet have a flexible and versatile selectable program of operations. The present invention overcomes this problem.

The general purpose of this invention is to provide a game time and events processor and display which embraces all the advantages of similarly employed game clocks and timing apparatus and possesses none of the afordescribed disadvantages. To obtain this the present invention contemplates a uniquely programmed array of storage elements in combination with a microcomputer containing a central processor unit, a data storage memory, display decoders and devices, a keyboard input, a low voltage detector and an alarm system whereby a versatile game dedicated microcomputer is provided with a flexible program of activities and functions.

An object of the present invention is the provision of a game microcomputer having a variety of selectable game modes which process and display time and events data of interest for each game according to a selectable digital display format in which the leading zeros are blanked to conserve power.

Another object is to provide a game microcomputer which alternately counts from at least two adjustably preset numbers and simultaneously displays both counts, the decimal point of the non-selective count display being blanked to indicate the non-active count.

A further object of the invention is the provision of a game microcomputer which corrects for illegal moves by storing the time of each move event in its memory and recalling and displaying the correct data prior to the illegal move.

Still another object is to provide a game microcomputer having a time display in which the two least significant digits of seconds and tens of seconds may be blanked until a certain pre-selected time or event occurs to conserve power until these digits are needed.

Yet another object of the present invention is the provision of a game microcomputer in which the number of moves of each player of a game may be stored and displayed upon command and which number and display for each player may be adjusted or corrected to a new number.

A still further object of the invention is to provide a game microcomputer with an alarm which may be activated upon the occurrence of an adjustable pre-selected time or event.

A yet further object of the present invention is to provide a game microcomputer with a keyboard input and which produces a warning indication when improper data and control keys on the keyboard are depressed and further prevents the resulting improper data and control instructions from being entered from the keyboard.

A still further object of the invention is to provide a game microcomputer having an alarm which indicates when the battery supply voltage drops below a preselected level.

Other objects and many of the attendant advantages of this invention will be readily appreciated as the same becomes better understood by reference to the following detailed description when condsidered in connection with the accompanying drawings in which like reference numerals designate like parts throughout the figures thereof and wherein;

FIG. 5 shows a flow diagram of the key sequence required to enter certain data and control instructions.

Figure 1:
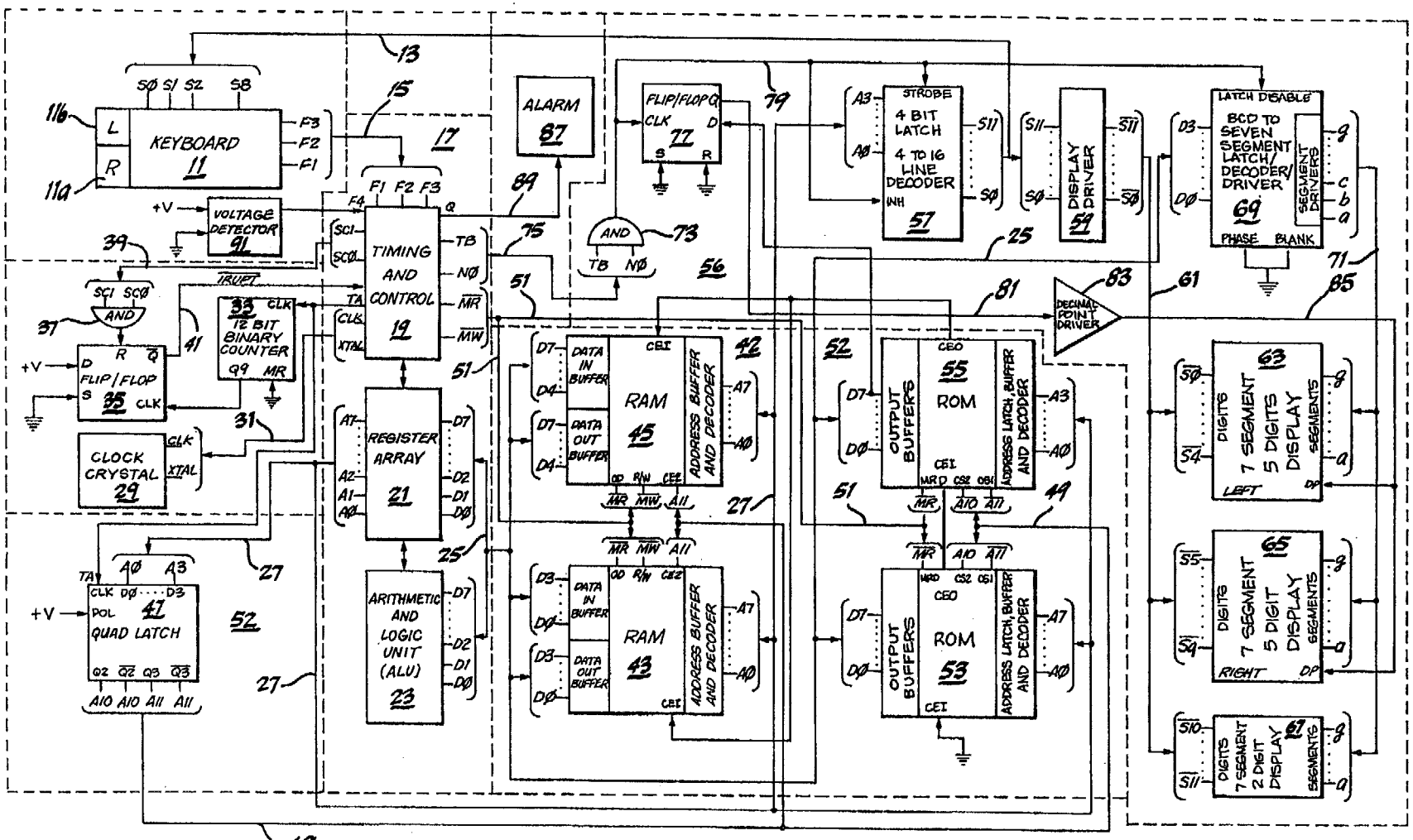
FIG. 1 illustrates an electrical block diagram of a preferred embodiment of the invention.

Referring now to the drawings wherein like reference characters designate like or corresponding parts throughout the several views, there is shown in FIG. 1 (which illustrates a preferred embodiment) a keyboard 11 having a left player switch **11*b* designated as L and a right player switch 11*a* designated as R. Keyboard 11** has a 9 bit digital bus input comprising lines Sϕ through S8 and an output 3 bit-digital bus 15 comprising lines F1, F2 and F3.

Output bus 15 connects keyboard 11 with a central processing unit 17 which has a timing and control section 19 interconnected with a register array 21 which in turn is interconnected with an arithmetic and logic unit (ALU) 23. Timing and control section 19 has input lines F1, F2 and F3 connected to bus 15, and further has input lines F4, $\overline{IRUPT}$, CLK and XTAL which will be further described hereinafter. Timing and control section 19 has output lines SC1, SCϕ, TA, TB, Nϕ, $\overline{MR}$ and $\overline{MW}$ all of which will be further described hereinafter. Register array 21 is connected to an output bus 27 comprising eight lines Aϕ through A7 which transmit binary coded memory address locations. Further, register array 21 is connected to an 8 bit bidirectional data bus 25 comprising lines Dϕ through D7 which data bus in turn is connected to arithmetic and logic unit (ALU) 23.

A clock crystal 29 is connected by a bus 31 containing lines CLK and XTAL which are connected to timing and control section 19. Crystal 29 is the frequency determining element used for generating the timing information for timing and control section 19.

Line TA of timing and control section 19 is connected to the clock input CLK of a 12 bit binary counter 33. The 9th bit output Q9 of counter 33 is connected to the clock input CLK of a flip-flop 35. Reset input MR of counter 33 is connected to circuit ground (logic O). Set input S of flip-flop 35 is connected to circuit ground and data input D is connected to a logic 1, which is a voltage +V. Reset input R of flip-flop 35 is connected to the output of an AND gate 37. The inputs to AND gate 37 are lines SCϕ and SC1 of bus 39 connected to timing and control section 19. Output $\overline{Q}$ of flip-flop 35 is connected by a line 41 to $\overline{IRUPT}$ input of timing and control section 19.

8 bit memory address bus 27 and bidirectional data bus 25 are connected to a random access memory (RAM) 42 having a first RAM 43 which has input data buffers connected to data lines Dϕ through D3 which are the first 4 bits of the 8 bit data bus 25 and comprise a "word" or "byte". RAM 43 has an input address buffer and decoder to which memory address lines Aϕthrough A7 are connected.

A second RAM 45 is identical to RAM 43 except that its data input and output buffers are connected to data lines D4 through D7 of the eight line bidirectional data bus 25, and comprise a second "word" or "byte".

Address lines Aϕ through A3 are connected by address bus 27 to a quad latch 47. Lines Aϕ through A3 are connected respectively to inputs Dϕ through D3 of quad latch 47, the clock input CLK of quad latch 47 being connected to timing pulse output TA of timing and control section 19. Polarity input POL of latch 47 is connected to a logic 1 (voltage +V), Output Q2, $\overline{Q2}$, Q3 and $\overline{Q3}$ of latch 47 are respectively connected to lines A10, $\overline{A10}$, A11 and $\overline{A11}$ of an address bus 49. Line A11 in turn is connected to chip enable input CE2 of both RAMS 43 and 45. Read and write input R/W and outut disable OD of RAMS 43 and 45 are connected respectively to memory write line $\overline{MW}$ and memory read line $\overline{MR}$ of timing and control section 19 by a connecting bus 51.

Connecting bus 51 further connects $\overline{MR}$ to a read only memory section (ROM) 52 comprising a read only memory (ROM) 53 and a read only memory (ROM) 55. ROM 52, 53 and 55 have output buffers which are connected to lines Dϕ through D7 of bidirectional data bus 25 and further have an address latch, buffer and decoder section connected to address lines Aϕ and A7 of address bus 27. Chip select inputs CS1 for ROM 53 and ROM 55 are connected to line $\overline{A11}$ of bus 49 and chip select input CS2 for ROM 53 and ROM 55 are connected respectively to line A10 and $\overline{A10}$ of bus 49. A memory read disable input MRD to both ROM 53 and ROM 55 is connected by bus 51 to $\overline{MR}$ output of timing and control section 19.

A chip enable input CEI of ROM 53 is connected to logic zero (circuit ground) and a chip enable output CEO of ROM 53 is connected to a chip enable input CEI of ROM 55. A chip enable output CEO of ROM 55 is further connected to a chip enable input CEI on both RAMS 43 and 45. The cascading of CEOS of ROMS 53 and 55 in this manner enables the selection of RAMS 43 and 45 when ROMS 53 and 55 are not selected.

It should be noted that some of the ROMS available to the designer have built in address latches to latch all higher-order address bits such as in the RCA CDP 1833 ROM and therefore latch 47 would not be required. The use of this type of ROM is contemplated within this invention although not illustrated.

Address bus 27 further connects address lines Aϕ through A3 to a 4 bit latch and a four to sixteen line decoder 57 of a display section 56. Decoder 57 has an inhibit input INH connected to a strobe line 79. Twelve of the sixteen line outputs, Sϕ through S11 of latch and decoder 57 are connected to an input display driver 59. Lines Sϕ through S8 are also connected by bus 13 to keyboard 11. Output lines $\overline{S\phi}$ through $\overline{S11}$ of display driver 59 are connected by a bus 61 to a seven segment five digit left display 63 and a seven segment five digit right display 65 and a seven segment two digit display 67. Display 63 is connected to lines $\overline{S\phi}$ through $\overline{S4}$, display 65 is connected to lines $\overline{S5}$ through $\overline{S9}$ and display 67 is connected to lines $\overline{S10}$ and $\overline{S11}$.

Data lines Dϕ through D3 are connected by data bus 25 to the input of a BCD (Binary Coded Decimal) to a seven segment latch/decoder/driver 69. Latch-/decoder/driver 69 has phase and blank inputs connected to circuit ground and has the outputs a, b, c, d, e, f and g of a seven segment driver connected by a bus 71 to each of the seven segment displays 63, 65 and 67.

An AND gate 73 has two inputs connected by a bus 75 to lines TB and Nϕ of timing and control section 19. The output of AND gate 73 is connected by a line 79 to the latch disable input of latch/decoder/driver 69 and the strobe and output inhibit INH inputs to latch and decoder 57 and to the clock input CLK of a flip-flop 77.

Flip-flop 77 has a set input S and reset input R connected to circuit ground (logic 0) and a data input D connected to data line D7 of data bus 25. An output Q of flip-flop 77 is connected by a line 81 to the input of a decimal point driver 83 which in turn has its output connected by a line 85 to a decimal point input DP of displays 63 and 65.

An alarm 87 is connected by line 89 to the Q output of timing and control section 19.

A voltage detector 91 which is connected to a battery supply voltage +V and to circuit ground and has an output which is connected to flag input F4 of timing and control section 19.

Figure 2:
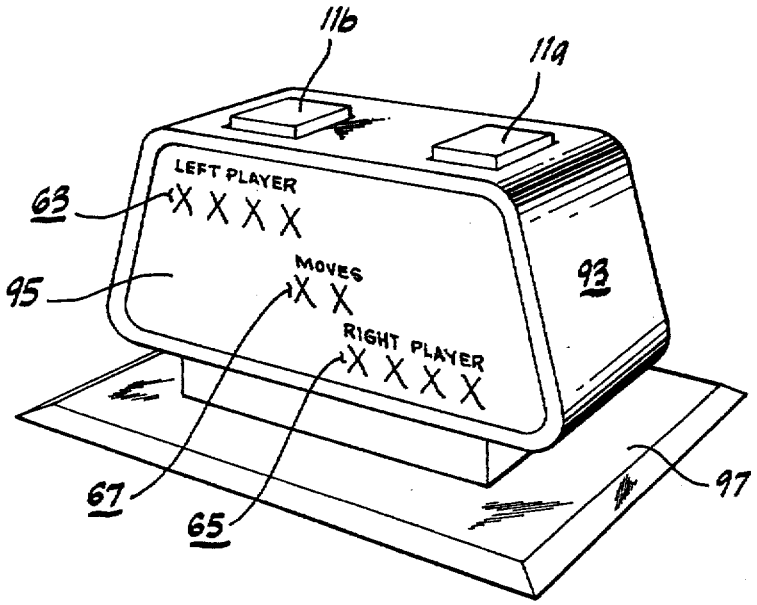
FIG. 2 illustrates a perspective view of the invention in its cabinet enclosure.

Turning now to FIG. 2, there is shown a pictorial view of the cabinet enclosure of the invention illustrated in FIG. 1. A substantially trapazoidal shaped cabinet 93 with rounded corners contains all the elements described and illustrated in FIG. 1. Cabinet 93 has a face plate 95 through which displays 63, 65 and 67 are viewed. Display 63 has a designation "left player" above five display digits indicated by a row of five X's located in the upper left hand corner of face plate 95. In the lower right hand corner of face plate 95 is located display 65 designated as "right player" above a row of five digits indicated by five X's. In the center of face plate 95 is located display 67 which has the designation of "Moves" above two digits indicated by a row of two X's. On top of cabinet 93 are located right player switch 11*a* and left player switch 11*b*. These switches are illustrated as rectangular push button switches. Cabinet 93 is further mounted on a pedestal and base plate 97.

Figure 3:
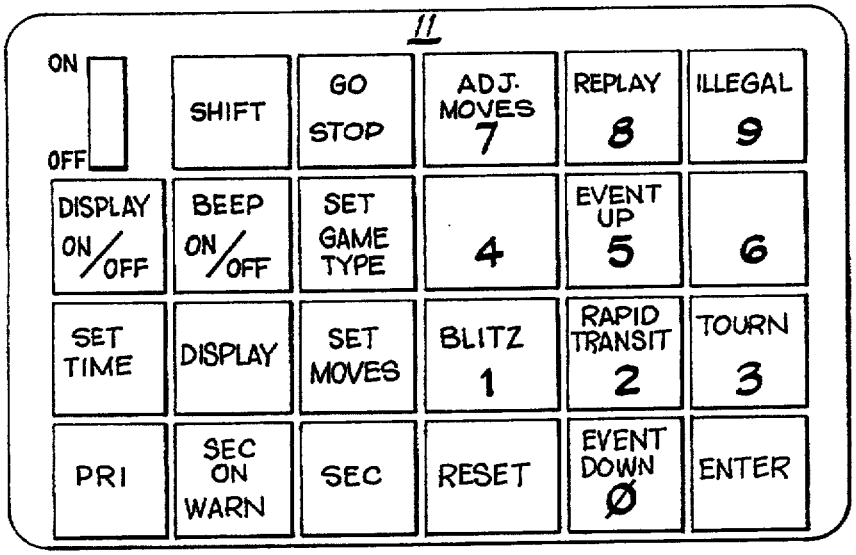
FIG. 3 illustrates the keyboard layout located on the back of the cabinet of FIG. 2.

In FIG. 3 there is illustrated a rectangular keyboard containing twenty-three push button keys and an on/off switch. This is keyboard 11 of FIG. 1 and is located on the back of cabinet 93 and is not visible in FIG. 2. Keyboard 11 has the following switches and keys starting from the upper left hand corner and going across the drawing from left to right in each row of keys: ON/-OFF; SHIFT; GO; STOP; ADJ (Adjust) MOVES, (digit) 7; REPLAY, (digit) 8; ILLEGAL, (digit) 9; DISPLAY ON/OFF; BEEP ON/OFF; SET GAME TYPE, (digit) 4; EVENT (events) UP, (digit) 5; (digit) 6; SET TIME; DISPLAY; SET MOVES; BLITZ, (digit) 1; RAPID TRANSIT, (digit) 2; TOURN (tournament), (digit) 3; PRI (Primary), SEC (Seconds) ON, WARN (warning); SEC (secondary), RESET; EVENT (events) DOWN, (digit) $\phi$; and ENTER.

Figure 4:
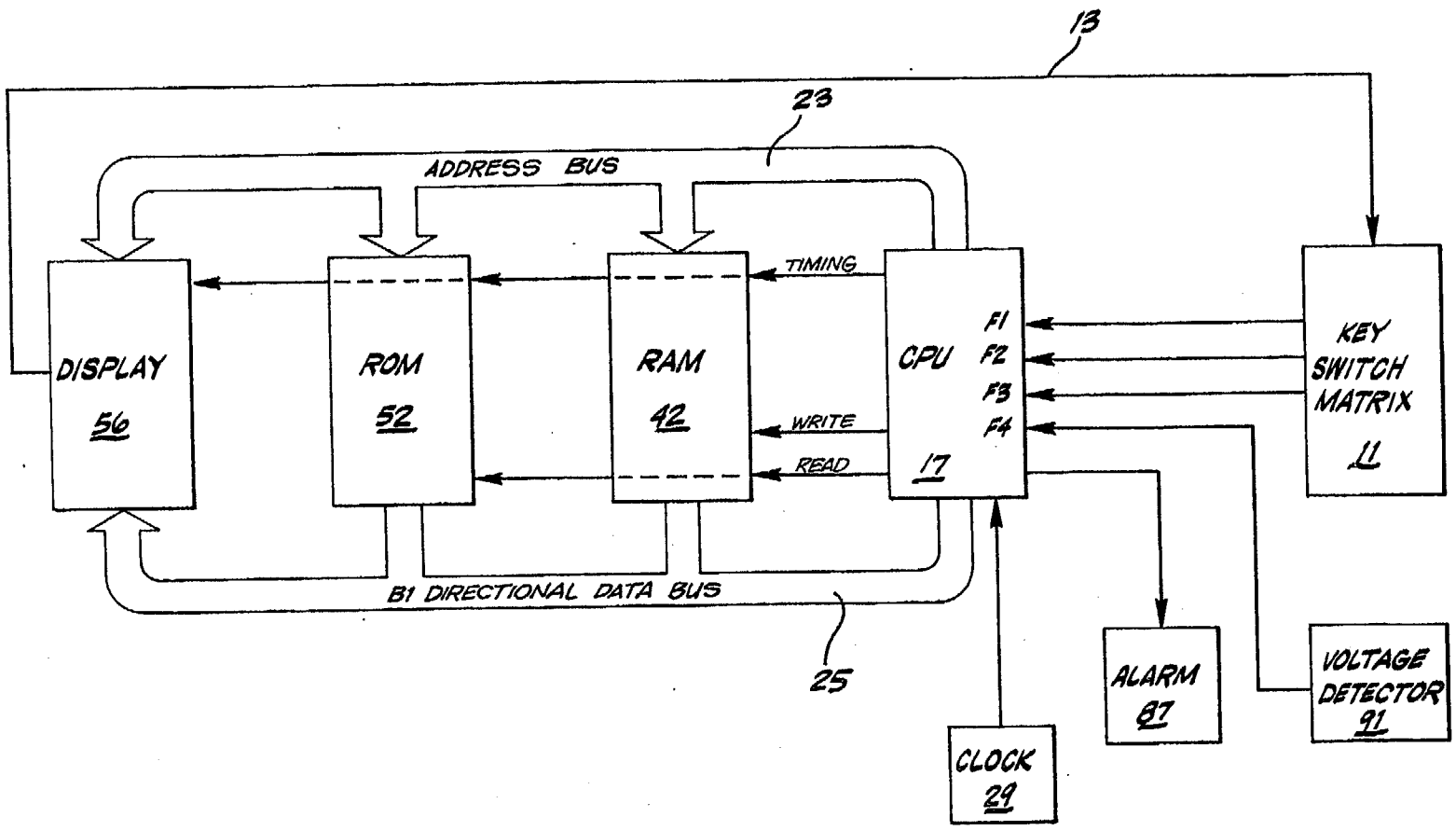
FIG. 4 illustrates a simplified block diagram of the invention.

FIG. 4 illustrates a simplified block diagram of the essential sections of the invention described in FIG. 1. Key switch matrix 11 is connected to flag inputs F1, F2, and F3 of central processor unit (CPU) 17. Flag input F4 of CPU 17 is connected to voltage detector 91. CPU 17 is further connected to clock 29 and alarm 87. Address bus 23 connects CPU 17 to RAM 42, ROM 52 and display 56. Bi-directional data bus 25 connects CPU 17 with RAM 42, ROM 52 and display 56. Select bus 13 is connected from display 56 to key matrix 11. Timing information is connected from CPU 17 to RAM 42, ROM 52, display 56. A "write" command is connected from CPU 17 to RAM 42 and a "read" command is connected from CPU 17 to RAM 42 and ROM 52.

Turning now to FIG. 5, there is shown a flow-chart of the sequence in which buttons on keyboard 11 are depressed in order to enter required information and desired operational commands. The sequence of commands or data input illustrated in FIG. 5 will be discussed further hereinbelow in respect to operation of the game microcomputer.

Operation of the invention can best be described by reference to FIGS. 1 and 4. The heart of the game microcomputer is the central processor unit or CPU 17. The CPU or microprocessor is generally fabricated on one or two semi-conductor chips. While no standard design has been adopted in existing units, a number of well delineated areas are present in all of them, namely, arithmetic and logic unit, timing and control block, and register array. When joined to a memory storage system, the resulting combination is referred to as a microcomputer. CPU 17 may be of the type manufactured by RCA, such as the CDP 1802 and the like. This is an 8 bit microprocessor which uses mostly single byte commands or instructions. The CDP 1802 microprocessor is formed on a single chip packaged in a 40 pin package configuration. Register array 21 includes an array of 16 general purpose scratch pad registers, each of which holds a 16 bit word. A register is a memory on a smaller scale. The words stored therein may involve arithmetical, logical or transferral operations. Storage in the registers may be temporary, but even more important is their accessibility by CPU 17 and the number of registers in a microprocessor is considered one of the most important features of its architecture. The term scratch pad is applied to information which CPU 17 stores or holds temporarily in register array 21. The scratch pad registers are substantially memories containing subtotals for various unknowns which are needed for final results. Therefore, scratch pad registers are substantially a bank of multiple bit registers used as temporary storage locations for data or instructions. The contents of any register can be directed to any one of three paths, namely, external memory, to an accumulator associated with ALU 23, and to an increment-/decrement circuit which is included in register array 21. Each of the scratch pad registers may be used as a program counter or as a data pointer to indicate the location of data in the memory. Any of the 16 general purpose registers can be designated to function as a program counter, memory address register, data source, or data destination, just by setting one of 3 available 4 bit pointer registers also included in register array 21, which are designated as the N, P and X registers (not illustrated). There is also another register included in register array 21, called the D register (not illustrated) which holds 8 bits, buffers data transfers between the scratch pad registers and the data bus and functions as an accumulator. The number of the selected scratch pad register which is used as the main program counter is held in the P register or designator. Thus, by changing the contents of the P register, the program counter is changed. The N register stores a variable pointer that is directed by a given instruction. The other 4 bit register, X, stores a pointer that designates an address register during input-output operations and some arithmetic logic unit instructions. Like the P register, it can be loaded by a single instruction.

The D register in register array 21 is connected to arithmetic and logic unit (ALU) 23. The ALU performs operations between data stored in the D register and in memory, with the results stored in the D register. The D register provides one operand for any arithmetic or logic function. The arithmetic and logic unit (ALU) is a complex array of gates that can be used to perform binary arithmetic, logic operations, shifts and rotates and complementing.

Instruction cycles for the CPU are divided into "fetch" and "execute" halves often referred to as machine cycles. During the fetch cycle, instructions are brought from the memory program, the 4 most significant bits being placed in a register in register array 21 designated as the I register which designates a particular class of instructions and the 4 least significant bits are funneled into the N register which defines the specific processor operation. The address of the memory location from which the instruction is fetched is contained in the program counter register.

Communication with the CPU is carried out over a variety of lines. The 8 bit bidirectional data bus lines D$\phi$ through D7 or bus 25 are used for transferring data among the memory sections 42 and 52, the CPU or microprocessor 17, and output display section 56. Lines TA and TB are positive pulses that occur once in each machine cycle and are used to time interaction with the address and data busses, respectively. The trailing edge of TA is used by the memory system to latch the higher-order byte of the 16 bit memory address which appears at the output of quad latch 47.

Lines SCϕ and SC1 are state code lines which indicate whether CPU 17 is fetching an instruction, or executing an instruction, or acknowledging an interrupt or direct memory access (DMA) request. When both lines are low (logic 0) the CPU is in a fetch state and when SC1 is low and SCϕ is high (logic 1) the CPU is in the execute state, and when both lines are high, the CPU is in the interrupt state.

Line $\overline{MW}$ produces a negative pulse in a memory write cycle after the address lines to the memory have stabilized. The $\overline{MR}$ line indicates a memory read cycle when a low level appears thereon. $\overline{MR}$ is used to indicate the direction of data transfer into or out of RAM 42 and out of ROM 52. When $\overline{MR}$ is high, data may flow into RAM 42 and when MR is low, data may flow from either RAM 42 or ROM 52.

Turning now to the memory address lines, the higher order byte of the 16 bit memory address appears on the memory address lines Aϕ through A7 first. Those bits required by the memory system are strobed into external address latches, if required by timing pulse TA. In FIG. 1, the external address latch is quad latch 47. Information present at the data input lines Dϕ through D3 of quad latch 47 is transferred to outputs Q2, $\overline{Q2}$, Q3 and $\overline{Q3}$ during the high clock level. The lower order byte of the 16 bit address appears on the address lines after the termination of timing pulse TA.

Line Nϕ is used to issue a command to output display section 56. The Nϕ line is low at all times except when an output instruction is being executed.

Interrupt line $\overline{IRUPT}$ accepts an interrupt request to go into a user written interrupt routine. At the conclusion of the interrupt, a return routine restores the pre-interrupted conditions in CPU 17. This interrupt routine will be better understood in the following discussion in respect to lines F1 through F4.

Lines F1 through F4 transfer status information to CPU 17. These lines are continually tested by conditional branch instructions in the program which are initiated by the interrupt request line $\overline{IRUPT}$.

The clock input line CLK is the input for an externally generated single phase clock and is used with the XTAL line in connection with external crystal 29. The crystal is connected between these two terminals generally in parallel with a resistance and frequency trimming capacitors. All the timing functions are controlled by clock crystal 29. The high frequency clock signal is divided into 16 periods internally to CPU 17. The first eight are used to control the fetch cycle, and the second eight control the execute cycle.

TA and TB output lines of CPU 17 are timing signals that can latch memory address bits, transfer data, and set or reset flip-flops The interrupt provided by binary counter 33 and flip-flop 35 and gate 37 suspends the normal programming routine of CPU 17. To generate the interrupt signal, the timing pulses appearing on line TA every machine cycle are counted in 12 bit binary counter 33. At output Q9 of binary counter 33, a pulse appears at a frequency rate of 600 Hz or every 1.67 milliseconds. This 600 Hz pulse frequency causes flip-flop 35 to produce a low output at $\overline{Q}$ if reset R is low. A low output on $\overline{Q}$ is an interrupt indication to CPU 17. If SCϕ and SC1 inputs to AND gate 37 are in any state except a high state, there will be a low input to reset input R of flip-flop 35. Therefore, when R is low and a pulse appears at CLK input to flip-flop 35, then $\overline{Q}$ will be low and an interrupt will be requested to CPU 17. When CPU 17 enters the interrupt state, SCϕ and SC1 go to their high state and produce a high state input to reset R of flip-flop 35 causing $\overline{Q}$ then to go into a high state and removing the interrupt request to CPU 17. During the interrupt period, input lines F1 through F4 transfer status information to CPU 17 and the output displays are updated. Therefore, every 1.67 milliseconds new input conditions are checked and the output displays are updated.

The $\overline{Q}$ output from CPU 17 is a single bit output which can be set or reset under program control and is used to operate alarm 87.

RAM 43 and RAM 45 may be a 256×4 bit high speed CMOS such as the S5101 manufactured by American Microsystems, Inc. or CDP 1822 manufactured by RCA or the like. The very low power of this type of RAM makes them an ideal choice for battery operation. The operation is fully static, making clocking unnecessary for a new address to be accepted. The stored data is read out non-destructively and in the same polarity as the original input data. The outputs are disabled with output disable OD connected to $\overline{MR}$ of CPU 17, or when CE2 goes low, or $\overline{CE1}$ goes high, or during a write cycle when $\overline{MW}$ is low. During this time the output is forced into a high impedance state. The read/write input R/W or output disable OD input allows the RAM to be used with a common data bus by forcing the output into a high impedance state during a write operation. When CE2 is high, $\overline{CE1}$ is low, OD is low and R/W is high, the RAM is in the read operation and the output data buffers are able to produce an output onto the data bus line. When CE2 is high, $\overline{CE1}$ is low and R/W is low, the RAM is in a "write" operation and the output is in a high impedance state. When CE2 is in a low state, the RAM is in a "powered down" state and the output is in a high impedance state.

A control program that will guide CPU 17 through the various operations it must perform is stored permanently in ROM 53 and ROM 55 where it can be accessed by CPU 17 during operations.

Each of ROM 53 and 55 is programmed by a mask pattern as part of the last manufacturing step. This program sets the mosaic of storage cells in the same manner as a computer programmer would if he would load a program in from a paper or magnetic tape into the memory. However, the mask programmed ROM is permanently programmed and cannot be erased. It should be noted that there is another ROM which is programmable in the field with the aid of programmer equipment. This type of ROM is designated as a P/ROM. However, again as in the mask programmed ROM, the P/ROM is permanently programmed. There is still another type of ROM called the EPROM which is erasable by ultraviolet irradiation and electrically reprogrammable. It should be noted that any of these types of read only memories could be used in the present invention.

ROM 53 and ROM 55 may be of the CDP 1833 CD and CDP 1833 D variety manufactured by RCA which are 8 bit mask programmable COS/MOS memories organized as 1,024 word storage and respond to a 16 bit address on 8 address lines. Address storage is provided on the chip to store the 8 most significant bits of the 16 bit address. The ROM can be programmed to operate in any 1,024 word byte of the array space. Two chip select signals CS1 and CS2 are provided. Therefore, signals on lines $\overline{A10}$ and $\overline{A11}$ and A10 indicate which memory bank is selected in either ROM 53 or ROM 55. When $\overline{MR}$ line goes low, the output buffers are enabled and the information stored in the storage locations indicated by the address input is transmitted out through the buffers to the bidirectional data bus.

The 4 bit latch and 4 to 16 line decoder 57 hold the last input data presented on lines Aϕ through A3 prior to the strobe transition from a high to low. When the strobe transition goes from a low to a high state, the data inputs on lines Aϕ through A3 which has been latched are then decoded into a selected output, which output appears at Sϕ through S11 when the INH (strobe) goes low. Display driver 59 then inverts the particular line Sϕ through S11 which is activated and applies it to the digit displays 63, 65, and 67. The display drivers may be of the type manufactured by Texas Instruments designated as a ULN 2003A which are monolithic high voltage, high-current Darlington transistor arrays.

The 12 bit binary counter 33 may be of the type manufactured by Motorola semi-conductors designated as MC 14040B, which is a 12 stage binary counter constructed with MOSSPP channel and N channel enhancement mode devices in a single monolithic structure. There are 12 stages of ripple carry binary counter. The counter advances the count on a negative going edge of the clock pulse.

Latch/decoder/driver 69 may be of the type manufactured by Motorola semi-conductors designated as MC 14543B which is constructed with complementary mos (CMOS) enhancement mode devices. The circuit provides the functions of a 4 bit storage latch and a BCD to 7 segment decoder and driver. The latch disable input is used to store a particular BCD code.

The 7 segment digital displays 63, 65 and 67 may be of the LED type manufactured by National further designated as the "National stick".

Keyboard 11 may be of the type manufactured by K. B. Denver for use as a microprocessor keyboard.

Turning now to the Keyboard sequence, when the game microcomputer is first turned on, or after the "RESET" key has been pressed on the keyboard, data lines Dϕ through D3 direct that none of the segment lines a through g be activated so that as address lines Aϕ through A3 sequence lines Sϕ through S11, no digits are displayed on displays 63, 65 and 67. However, data line D7 and the output of AND gate 73 set flip-flop 77 to cause decimal points to be displayed in each digit location except display 67 (moves) as lines Sϕ or through S11 are sequenced. The program stored in ROMS 53 and 55 then instructs CPU 17 to look for the pressing of the key "SET GAME TYPE" as indicated in FIG. 5. When either the "TOURN", "RAPID TRANS" or "BLITZ" keys are pressed, the program causes the first two digits in each of the five digit display units 63 and 65 to be blanked and a zero with a decimal point to be indicated in the third digit location. The program also causes the fourth digit to be blanked and a zero to show in the fifth digit position. This is produced by a routine in the program which causes all the leading zeros to be blanked. In the case of the three game keys "BLITZ", "RAPID TRANS", "TOURN" being pressed, the first three digits of the five digit display 63 and 65 display minutes and the third and fourth digits display seconds. Therefore, the two leading zeros in the minutes section are blanked and one leading zero in the seconds section is blanked.

When the "EVENTS UP" or the "EVENTS DOWN" are pressed, nothing appears in the first and third digit locations and a zero and a decimal point appear in the second and fourth digit locations and a zero appears in the fifth digit location. In these two conditions the first two digits indicate minutes, digits 3 and 4 indicate seconds and digit five indicates tenths of a second with the program again blanking leading zeros.

If the "TOURN" button was pressed, the chess tournament game is selected and the program allows each player to have a primary and secondary time period in which to make a given number of moves. Also the program allows for a primary and secondary number of moves to be entered into the memory. In order to set these times and number of moves into the game microcomputer, the "SET TIME" key is pressed and then the "LEFT" or "RIGHT" player switch is actuated so that the time period will be stored in the proper player location or in the alternative if the left or right player switch is not depressed, then the same time will be stored for both players. If either the "PRI" or "SEC" switches is pressed, indicating either primary or secondary time, the program instructs CPU 17 to look for the key input of time digits. As the digits ϕ through 9 are pressed to indicate the time selected, the program causes the first digit to appear in the fifth or extreme right digit location of 5 digit displays 63 and 65 and then to shift from right to left into digit location 4 as the second digit key is pressed. Then these two digits shift another location to the left as the third digit key is pressed, until all five digit keys have been pressed or the corresponding number of digit keys to indicate the desired time in minutes and seconds. For example, if the left player is allocated two hours, the left player display will show 120.00 indicating 120 minutes and 0 seconds. As soon as the "ENTER" key is pressed, the program will cause the leading 0 in the seconds display to be blanked.

If the same time is being stored for both players, then the time stored will appear in both displays 63 and 65 when the "ENTER" key is pressed.

It should be noted that the purpose of blanking leading zeros is to conserve power by not illuminating that digit which bears no number information.

To set moves the "SET MOVES" key is pressed instead of the "SET TIME" key and the same key sequence as discussed above is followed. Again, the digits enter the two digit display 67 from the right and a number up to 99 may be inserted. If less moves than ten are inserted, the leading zero is blanked similar to the time displays.

If a warning is to be initiated at specific times during either the primary or secondary time periods, the program permits the insertion of a specific time or sequence of times into RAM 43 and 45 at which selected times CPU 17 activates alarm 87. First, the "SET TIME" button is pressed, and then the "WARN" button is pressed, and then the same sequence of keys are pressed as were pressed in setting the primary and secondary times. If a warning time is to be set in the primary time period, then the primary button "PRI" is pressed or if it is to be inserted in the secondary time period, then the "SEC" button is pressed. Then, as before, if the time periods are related to either the "LEFT" and "RIGHT" player, then the corresponding "LEFT" or "RIGHT" player switch is pressed. If the same warning time is to be used for both players, then the player switch actuation may be omitted. However, after the "ENTER" key is pressed, it is necessary to press "BEEP ON/OFF" key to enable the alarm to be activated at the particular warning times selected and stored in RAM 42.

The program stored in ROM 52 allows for the number of player moves entered into RAM 42 to be used only in the chess tournament game condition and only a secondary time period entered in RAM 42 to be used in the "BLITZ" and "TOURN" game conditions. Once the time and moves and warning times have been inserted into RAM 42 and the game has been played, if the same time periods and moves and warning times are desired for a subsequent game, they do not need to be reinserted. The program provides for an automatic setup of a subsequent game using the same numbers and data from the preceding game by pressing the "SHIFT" key and then the "REPLAY" key to reset the game microcomputer automatically to the original numbers that were inserted for the previous game.

To verify the times and moves that were inserted into the program and to display what numbers have been entered, the program provides for pressing the "DISPLAY" key and then the "PRI" or "SEC" keys to display either the primary or secondary times with the corresponding numbers appearing in the left player's and right player's display locations, and in the tournament mode, moves may be displayed. If different times are being inserted for each player, then the corresponding player switch is activated after pressing the "DISPLAY" key.

Similarly, the time set for the warning alarm to be sounded is displayed in a similar manner by pressing the "DISPLAY" key, the "WARN" key, and the "PRI" or "SEC" keys to display the times at which the alarm will be activated in either of the secondary or primary time periods. Again, if different times have been inserted for each player, then the appropriate player switch is activated after the "WARN" key.

In order to further conserve power, when a count begins from a large number, such as 120 minutes, it is unnecessary to have the seconds digits displayed since they are of little importance until the end of the time period. Therefore, the program provides for blanking the two least significant seconds digits and to have them reappear at a predetermined selected time. To set the time for reappearance, the keys are pressed in the following sequence: First, "SET TIME", then "SHIFT", then "SEC ON", then key in the digits corresponding to the time desired, and then finally press the "ENTER" key.

Similar to the primary and secondary and warning times, the seconds on time can also be displayed to verify the correct number inserted by pressing the "DISPLAY" key and then the "SHIFT" key, and finally the "SEC ON" key to display the time at which the two least significant seconds digits will be activated.

Normally, there is no alarm at the end of a game. However, if it is desired to have an alarm sound to indicate the end of the game, the program provides for activating a two second beep at the end of a game by pressing the "BEEP ON/OFF" key at any time before the start of a game or when the game is stopped by pressing the "STOP" key.

After the primary and secondary times have been inserted and all the other desired information has been introduced into the memory, the game is started by the first player pressing his "LEFT" or "RIGHT" player key, at which time a count will start down from the number inserted in the primary time location for the opposite player. When the game microcomputer is running in this manner, the "STOP" key may be pressed at any instant to stop the time count. Once the clock has been stopped, the time count may be continued by pressing the "SHIFT" key and then the "GO" key and the time count will continue.

When a player presses his player key the program stored in ROM 52 causes the time and number of moves displayed for that player to be stored in RAM 42, and at the end of a game to be recalled and displayed so that a player may review each step of the game to see the time consumed for each move. The program also provides for the difference between times to be calculated and displayed so that a player may review the time consumed for each move.

Once the clock is stopped, it is possible to change the move count in the current time period without altering the timesettings. In order to do this, the program provides for first pressing the "SHIFT" key and then the "ADJ MOVES" key and then pressing the desired digits indicating the correct move count and finally pressing the "ENTER" key to insert the corrected count. To restart the game, then the "SHIFT" key is pressed and then the "GO" key is pressed and the game will continue with the new move count being displayed in the moves digits.

The program in ROM 52 provides for an illegal move correction during the tournament and rapid transit games. The program causes the time for both players and the moves for both players to be stored in RAM 42 whenever a player button is pressed. This enables the players to correct the time and moves if an illegal move is made. In order to correct the moves, the following sequence is used. First, the "STOP" key is pressed and then the "SHIFT" key, and then the "ILLEGAL" key is pressed. To indicate which player it was that made the illegal move, the "LEFT" or "RIGHT" button corresponding to the player who made the illegal move is pressed. To restart the game the "SHIFT" key is pressed and then the "GO" key is pressed. The play then continues with the same player's time being decremented as was before the illegal sequence was depressed. However, the time and moves are reset to the values before the illegal move occurred.

When the "RESET" key is pressed after pressing the "STOP" key or at the end of the game, all decimal points will again appear in all digit locations except display 67 (moves) to indicate that all previous game settings have been erased, and that the game microcomputer is now ready to receive new instructions.

In the Tournament game, there is an allowance for each player to have both a primary and secondary time period and a primary and secondary move count. Once the game has begun, if either the primary or secondary time becomes zero, the game is ended. When the move count becomes zero, the secondary time period is added to the remaining time for each player and the secondary move count is then displayed.

For the game Rapid Transit, the program provides only one time period for play, namely, the primary time period. No move count is displayed and when the time becomes zero the game is over.

ROM 52 is also programmed for Blitz which is a game with a primary time period as the time allowed per move and the secondary time period as a grace time period. The program causes only the player's time who is making the move to be shown and the other player's time is blanked along with the "moves" count digits which are not utilized. When the primary time becomes zero, the grace period is added in and if that becomes zero before a move is made the game is over. Each time a player presses his key, namely, "RIGHT" or "LEFT" player keys, the opposite player's time is reinitialized to the primary period.

Also, included in the program is "Events Down" mode which displays time as two digits of minutes, two digits of seconds and one digit of tenths of a second. This display is different from the tournament, rapid transit and blitz displays which display three digits of minutes and two digits of seconds. In the mode "Events Down" the game microcomputer can be used for timing sporting events and the like against or specified time. Only one display is used and time counts down.

The "Events Up" mode is the same as the "Events Down," only the time is counted up.

In both the "Events Up" and "Down" mode the initial time from which the count is either started up or down is inserted in the same manner as the times are entered into the primary and secondary time periods during the tournament, rapid transit or blitz games.

When either player's time reaches zero in the Tournament, Rapid Transit or Events Down game modes, if enabled, a two second alarm is activated. In the Blitz game mode, when the first time zero is reached, the grace period is added in and a 0.6 second alarm is activated, if previously enabled by the "BEEP ON/OFF" key.

In the events game mode, either players key can start or stop the counting, but once stopped, the count can be restarted again only by pressing the "SHIFT" key and the "GO" key.

When the "SECONDS ON" time is reached, the players time being displayed will show the seconds but the opposite player's seconds will not show until his time has begun next to decrement.

Since the primary purpose of the game microcomputer is to be able to operate from battery power, it is necessary to indicate when the battery is low. Therefore, when voltage detector 91 indicates the battery voltage has dropped below a predetermined value, voltage detector 91 initiates a command into CPU 17 and the program in ROM 52 causes the digital display 63, 65 and 67 to flash on and off. The display flashing is designed not only to notify the players of low battery power but to also conserve drain on the battery.

Further, the program indicates the active player by activating the decimal points for the active time display and blanking the decimal points in the non-active time display.

When the "SECONDS ON" key has been pressed in its proper sequence as discussed hereinabove, the least significant digits or the first two digits from the right are blanked in display 63 and 65 this means only the minutes digits will show in the chess game modes, and the minutes and tens of seconds digit during the events mode.

A further feature provided to conserve power when a game is stopped is the capability to turn off all move and time displays by activating the DISPLAY ON/-OFF key. Since the display section of the game microcomputer consumes most of the power, it is desirable to turn off the display section when a break in the game is taken by the players. To turn the displays on, the DISPLAY ON/OFF key is actuated and the game may then be resumed by the sequence of key actuations discussed hereinabove.

If the alarm is enabled by pressing "BEEP ON/OFF" key and a wrong key is pressed during any pre-game set up, the alarm will be activated to let the player know of the wrong sequence of key actuation.

It now should be apparent that the present invention provides a circuit arrangement which may be employed in conjunction with a game microcomputer for performing and controlling desired display of game data under the direction and control of a pre-programmed ROM.

Although particular components, programs, etc. have been discussed in connection with a specific embodiment of a game microcomputer constructed in accordance with the teachings of the present invention, others may be utilized. Furthermore, it will be understood that although an exemplary embodiment of the present invention has been disclosed and discussed, other applications and circuit arrangements are possible and that the embodiment disclosed may be subjected to various changes, modifications and substitutions without necessarily departing from the spirit of the invention.

What is claimed is:

1. A game clock, comprising:

display means for displaying a plurality of digits of decimal numbers;

memory means coupled to said display means and operable for receiving and storing at least one pre-determined programmed time period, said display means operable for counting and displaying the count from said at least one pre-determined programmed time period stored in said memory means; and control means coupled to said memory means and to said display means for instructing said display means to display said at least one pre-determined programmed time period and for starting and stopping said counting of said display means, said memory means operable to receive and separately store each and every one of the decimal number displayed each time said control means stops said counting of said display means, said control means operable to change each and every one of said decimal numbers separately stored in said memory thereby adjusting said count displayed by said display means.

2. The game clock described in claim 1 wherein said memory means further includes means operable to receive and store a value equivalent to the difference between any of said decimal numbers and adjusted decimal numbers stored in said memory.

3. The game clock described in claim 1 wherein said control means further includes means o, erable to restart the count of said display means from any of said decimal numbers stored.

4. The game clock described in claim 3, wherein said memory means further includes means operable to receive and store a sum equivalent to the number of starts and stops of the counting by said display means and wherein said control means further includes means operable to adjust the sum of starts and stops stored in said memory means and wherein said display means further includes means for displaying the adjusted sum of starts and stops.

5. The game clock described in claim 1 further including alarm means coupled to said control means for indicating the occurrence of an event in time and wherein said memory means further includes means operable to receive and store a number equivalent to a pre-determined programmed event in time and wherein said control means further includes means operable for selecting and transmitting said number to said memory means and for activating said alarm means when the count of said display means is equivalent to said number.

6. The game clock described in claim 1 wherein said display means further includes means operable for blanking selected ones of said plurality of digits and wherein said control means further includes means operable for selecting certain ones of said plurality of digits for blanking and wherein said memory means further includes means operable for storing identity of said certain ones of said plurality of digits for blanking.

7. The game clock described in claim 6 wherein said memory means further includes means operable to receive and store a selected number equivalent to a time at which the blanked digits are to be activated for display and wherein said control means further includes means operable for selecting and transmitting said selected number to said memory means and wherein said display means further includes means operable to activate said blanked digits when a count equivalent to said selected number is displayed on said display means.

8. The game clock described in claim 1 further including a power supply alarm connected to said control means for indicating when the power available to the game clock drops below a pre-determined level, said alarm including means for automatically reducing power consumption by said display means when the power available drops below said pre-determined level.

9. The game clock described in claim 8 wherein said power alarm is a voltage detector and indicates when the supply voltage to the game clock drops below a pre-determined specified value, said means for reducing power including means for periodically turning said display means "on" and "off".

* * * * *